US006170271B1

(12) United States Patent
Sullivan

(10) Patent No.: US 6,170,271 B1
(45) Date of Patent: Jan. 9, 2001

(54) SIZING AND CONTROL OF FRESH AIR DEHUMIDIFICATION UNIT

(75) Inventor: Brian T. Sullivan, La Crosse, WI (US)

(73) Assignee: American Standard Inc., Piscataway, NJ (US)

( * ) Notice: Under 35 U.S.C. 154(b), the term of this patent shall be extended for 0 days.

(21) Appl. No.: 09/118,029

(22) Filed: Jul. 17, 1998

(51) Int. Cl.[7] ..... F25D 17/06

(52) U.S. Cl. ..... 62/93; 62/176.1; 62/176.6; 62/176.3

(58) Field of Search ..... 62/93, 176.1, 176.6, 62/176.3

(56) References Cited

U.S. PATENT DOCUMENTS

| | | | | |
|---|---|---|---|---|
| 2,018,804 | | 10/1935 | Rasmusen | 257/2 |
| 2,241,060 | | 5/1941 | Gibson | 257/3 |
| 2,286,605 | | 6/1942 | Crawford | 62/6 |
| 3,402,564 | | 9/1968 | Nussbaum | 62/173 |
| 4,270,362 | | 6/1981 | Lancia et al. | 62/173 |
| 4,271,678 | | 6/1981 | Liebert | 62/173 |
| 4,457,357 | | 7/1984 | Van Arnhem | 165/21 |
| 4,582,123 | | 4/1986 | Williams | 165/21 |
| 4,607,498 | | 8/1986 | Dinh | 62/185 |
| 5,179,998 | | 1/1993 | Des Champs | 165/1 |
| 5,230,466 | * | 7/1993 | Moriya et al. | 236/44 |
| 5,309,725 | | 5/1994 | Cayce | 62/90 |
| 5,313,803 | * | 5/1994 | Detzer | 62/89 |
| 5,333,470 | | 8/1994 | Dinh | 62/333 |
| 5,400,607 | | 3/1995 | Cayce | 62/90 |
| 5,448,897 | | 9/1995 | Dinh | 62/333 |
| 5,666,813 | | 9/1997 | Brune | 62/90 |
| 5,791,153 | * | 8/1998 | Belding et al. | 62/93 |
| 5,799,728 | * | 9/1998 | Blume | 165/231 |
| 5,893,408 | * | 4/1999 | Stark | 165/66 |
| 5,896,751 | * | 4/1999 | Wakizaka et al. | 62/271 |
| 5,915,473 | * | 6/1999 | Ganesh et al. | 62/222 |
| 5,934,084 | * | 8/1999 | Lee | 62/93 |

OTHER PUBLICATIONS

"100 Percent Outdoor Air Unit for Outdoor Air Applications—Model FAUA", MUA–DS–6, May 1998.

* cited by examiner

*Primary Examiner*—William Doerrler
*Assistant Examiner*—Mark Shulman
(74) *Attorney, Agent, or Firm*—William J. Beres; William O'Driscoll; Peter D. Ferguson

(57) ABSTRACT

A fresh air unit. The unit comprises: a housing having an airstream flowing therethrough; a pre-cooling portion, and dehumidification portion. The pre-cooling portion is located within the housing and reduces the temperature and specific humidity of a gas in the airstream to a target zone on a psychrometric chart. The dehumidification portion is also located in the housing downstream of the pre-cooling portion. The dehumidification portion removes a selected amount of moisture from the gas and reheats the gas a selected amount of sensible heat gain.

26 Claims, 5 Drawing Sheets

FIG. 2
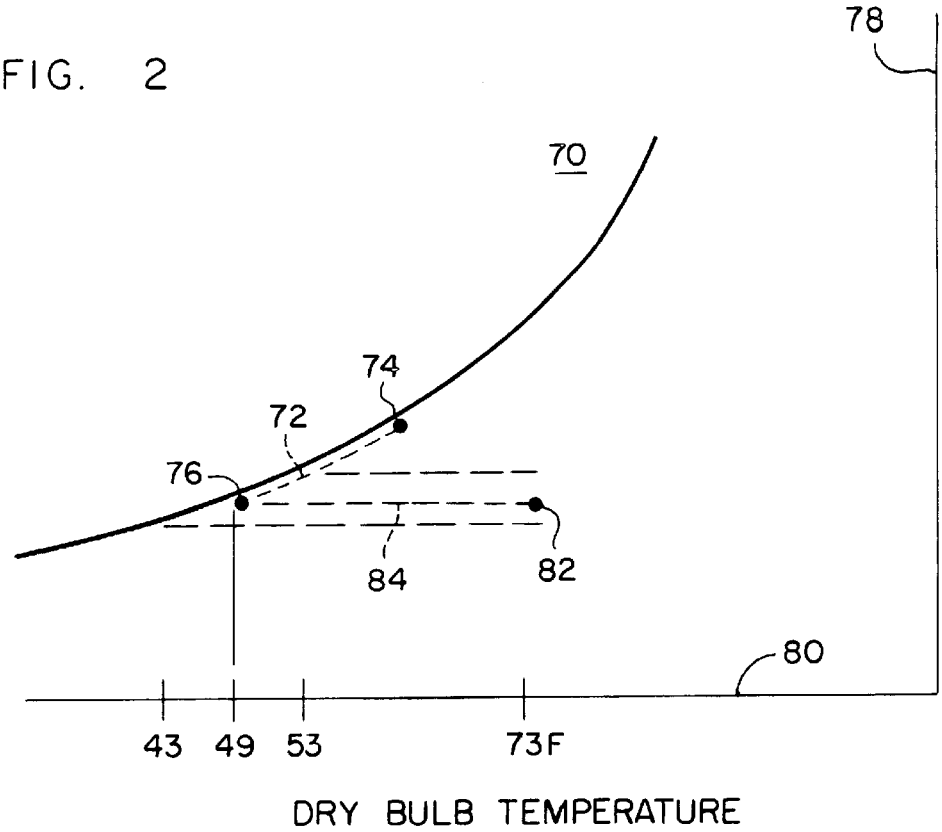
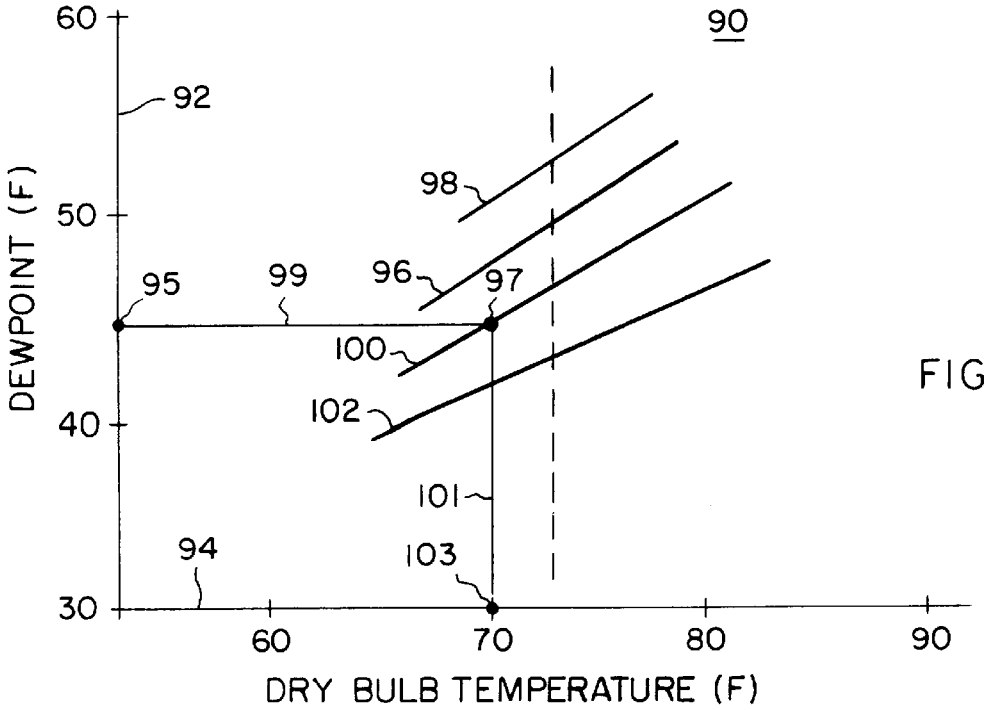
FIG. 3

SIZING AND CONTROL OF FRESH AIR DEHUMIDIFICATION UNIT

BACKGROUND OF THE INVENTION

The present invention focuses on a dedicated outdoor air treatment and ventilation system to deliver properly conditioned outdoor air in HVAC systems using terminal equipment such as fan coils, water source heat pumps and blower coils. The primary benefit of using this type of system is the ability to properly heat, cool and/or dehumidify the outdoor ventilation air independently of the other equipment in the system.

Poor indoor air quality can pose many risks for the building designer, owner and manager. The quality of the indoor environment can affect the health and productivity of the building occupants and even affect the integrity of the building structure itself. A building's indoor air quality is the result of the activities of a wide variety of individuals over the lifetime of a building, the atmosphere surrounding the building, the building materials themselves, and the way in which the building is maintained and operated. The interaction of these variables make achieving acceptable indoor air quality a complex, multi-faceted problem. Although complex, the fundamental factors which directly influence indoor air quality can be divided into four categories: (a) contaminant source control, (b) indoor relative humidity control, (c) proper ventilation, and (d) adequate filtration.

Ventilation is the process of introducing conditioned outside air into a building for the purpose of diluting contaminants generated within the spaces and of providing makeup air to replace air which is lost to building exhaust. The amount of ventilation air so required is established by building codes and industry standards, and varies with the intended use of the occupied spaces. Most building codes reference ASHRAE Standard 62–89 "Ventilation for Acceptable Indoor Air Quality" either in part or in entirety as a minimum requirement for ventilation system design. This standard is hereby incorporated by reference. ASHRAE Standard 62–89 recommends that "relative humidity in habitable spaces be maintained between 30 and 60 percent to minimize the growth of allergenic and pathogenic organisms". Additionally, indoor relative humidity levels above 60 percent promote the growth of mold and mildew, can trigger allergenic reactions in some people, and have an obvious effect on personal comfort. Extended periods of high humidity can damage furnishings and even damage the building structure itself. Controlling moisture levels within the building and the HVAC system is the most practical way to manage microbial growth.

The increased attention to indoor air quality (IAQ) is causing system designers to look more carefully at the ventilation and humidity control aspects of mechanical system designs particularly including dedicated outdoor air treatment and ventilation systems. These types of systems separate the outdoor air conditioning duties from the recirculated air conditioning duties. For simplicity, the present invention is discussed in terms of constant volume systems but is also intended to encompass variable air volume (VAV) systems.

Constant volume (CV) systems deliver a constant volume of airflow to a space at a temperature that varies in response to the thermal (or sensible load) requirements of the space. Examples of equipment commonly used in CV applications include direct expansion rooftop units, indoor air handlers, outdoor air handlers, and terminal products such as fan coils, unit ventilators, water source heat pumps, and blower coil units.

Constant volume systems are traditionally controlled based on space sensible temperature only. Any control of latent energy such as humidity is a byproduct of the sensible cooling process. Basic psychrometrics dictate that, to reduce space relative humidity, the supply air must be at a lower dewpoint than the space. At high space sensible loads, the leaving air temperature of the cooling coil is low, usually below the target dewpoint, resulting in adequate dehumidification. However, when the sensible load of the space is low (i.e., under part load conditions), the controller of the constant volume system responds by increasing the leaving air temperature to avoid overcooling the space. If the dewpoint of the air leaving the cooling coil is now above the targeted dewpoint for the space, inadequate dehumidification of the space occurs.

One approach to dealing with the reduced latent capacity of a constant volume system under these part load conditions is to separate the system outdoor and recirculated air paths. In such an arrangement, a dedicated central unit heats, cools and/or dehumidifies the outdoor air to an approximate comfortable temperature (65–80° F.) and an approximate low dewpoint (42–53° F.) dictated by the desires of the building owner or operator. Under most operating conditions, the outdoor air unit over cools the outdoor air to remove the required moisture and then reheats it back up to a room neutral condition of about 65–80° F. to avoid over cooling the space and unnecessary reheating at the terminal unit. Often the energy to reheat the entering outdoor air is recovered energy from the cooling process such as condenser heat.

Prior art systems have not been optimized to control the sensible and latent cooling of a unit providing outside air. Additionally, the sizing of the heat exchange coils in such a unit has not been optimized.

SUMMARY OF THE INVENTION

It is an object, feature and advantage of the present invention to solve the problems of the prior art systems. More specifically, the present invention optimizes the control and sizing of the heat exchange coils in an outdoor air conditioning unit.

It is an object, feature and advantage of the present invention to provide a separately ducted, ventilation airflow path to a space to assure that the ventilation air reaches the space.

It is an object, feature and advantage of the present invention to provide outdoor air directly to a space to accommodate relative humidity and temperature control.

It is an object, feature and advantage of the present invention to assure that a constant volume ventilation airflow rate can be easily balanced in a space by delivering the ventilation air through a dedicated diffuser.

It is an object, feature and advantage of the present invention to control humidity at all times in a day so as to greatly reduce the risk of microbial growth on building furnishings or inside a building HVAC system.

It is an object, feature and advantage of the present invention to dilute the buildup of indoor air contaminants by bringing outside air into a building as makeup air to replace air being exhausted from the building. It is a further object, feature and advantage of the present invention to ensure that the outside air is provided during unoccupied periods to compensate for any local exhaust which continue to operate during the unoccupied periods.

It is an object, feature and advantage of the present invention to critically size the dehumidification circuit of a fresh air unit. It is a further object, feature and advantage of the present invention to control a fresh air unit in order to maintain supply air temperature as well as maintain a desired humidity level.

It is an object, feature and advantage of the present invention to critically size the dehumidification portion of a fresh air unit to cause a desired amount of sensible heat gain from the dehumidifying condenser into the airstream of the fresh air unit.

It is an object, feature and advantage of the present invention to provide essentially constant heat rejection from the dehumidification condenser circuit so that the air temperature discharged from the dehumidification unit floats based on the entering outdoor conditions and upon the amount of any upstream pre-cooling.

It is an object, feature and advantage of the present invention to provide control in a fixed reheat system where pre-cooling stages are stepped on and off to maintain supply air temperature.

It is a further object, feature and advantage of the present invention to control humidity and temperature when experiencing varying and modulated airflows.

It is an object, feature and advantage of the present invention that the supply air temperature and the supply air dewpoint be independently controlled.

It is an object, feature and advantage of the present invention to cycle the dehumidifying portion of the fresh air unit so as to control the supply air dewpoint temperature.

It is an object, feature and advantage of the present invention to establish two adjacent cooling stages in a fresh air unit and to cycle between these stages so as to maintain a discharge setpoint by controlling the amount of time that each stage operates.

It is another object, feature and advantage of the present invention to establish an average supply air dry bulb temperature and, by maintaining that average supply air dry bulb temperature, to maintain a dewpoint even as the discrete supply air dry bulb temperature varies and as airflows varies.

It is an object, feature and advantage of the present invention to allow a user to select the desired leaving dewpoint temperature.

It is an object, feature and advantage of the present invention to allow a user to select the desired dry bulb temperature. It is a further object, feature and advantage of the present invention to allow a user to select the desired average dewpoint temperature.

It is an object, feature and advantage of the present invention to cycle a precooling portion of a fresh air unit to maintain a desired humidity level. It is a further object, feature and advantage of the present invention to cycle the precooling portion in response to a measured sensible temperature.

It is an object, feature and advantage of the present invention to cycle a dehumidification portion of a fresh air unit to maintain a desired humidity level. It is a further object, feature and advantage of the present invention to cycle the dehumidification unit in response to a measured sensible temperature.

It is an object, feature and advantage of the present invention to cycle a precooling portion and a dehumidification portion of a fresh air unit in response to measured temperature to maintain desired humidity levels.

It is an object, feature and advantage of the present invention to measure the discharge air temperature of a fresh air unit and to control the humidity level in that unit.

It is a further object, feature and advantage of the present invention to control humidity by cycling a precooling portion and/or a dehumidification portion of the fresh air unit.

The present invention provides a fresh air unit. The fresh air unit comprises: a housing having an airstream flowing therethrough; a pre-cooling portion, and a dehumidification circuit. The pre-cooling portion is located within the housing and reduces the temperature and specific humidity of a gas in the airstream to a predetermined target zone on a psychrometric chart. The dehumidification circuit is also located in the housing and is downstream of the pre-cooling evaporator coil. The dehumidification circuit removes a selected amount of moisture from the gas and reheats the gas a selected amount of sensible heat gain.

The present invention also provides a method of operating a fresh air unit having a precooling portion and a dehumidification portion. The method comprises the steps of: adjusting the capacity of the precooling portion; operating the precooling portion to control sensible and latent temperatures to a predetermined area of a psychrometric chart; and operating the dehumidification section to provide a fixed amount of dehumidification and a fixed amount of reheat.

The present invention further provides the operating the precooling portion step may include the further steps of establishing two or more adjacent cooling stages, cycling between these stages and controlling a discharge air temperature to a setpoint. Also, the average supply air dewpoint is controlled by establishing an average supply air drybulb temperature. The method can include the further steps of cycling at least a portion of the dehumidification section on and off to establish additional control points, and cycling the unit at the control points and thereby independently controlling average drybulb temperature and average dewpoint temperature.

The present invention further provides a method of operating a fresh air unit having an upstream precooling portion and a downstream dehumidification portion. The method comprises the steps of: determining a desired average dry bulb temperature; measuring dry bulb temperature; cycling the precooling portion in response to the measured dry bulb temperature to maintain the desired dry bulb temperature; and operating the dehumidification portion to control humidity and provide a fixed amount of reheat.

BRIEF DESCRIPTION OF THE DRAWINGS

FIG. 2 is a psychrometric chart showing the operation of the dehumidification portion of the present invention in accordance with FIG. 1.

FIG. 3 is a graph of dehumidification capabilities of the fresh air unit described in FIG. 1 at various airflow conditions.

DETAILED DESCRIPTION OF THE DRAWING

Figure 1:
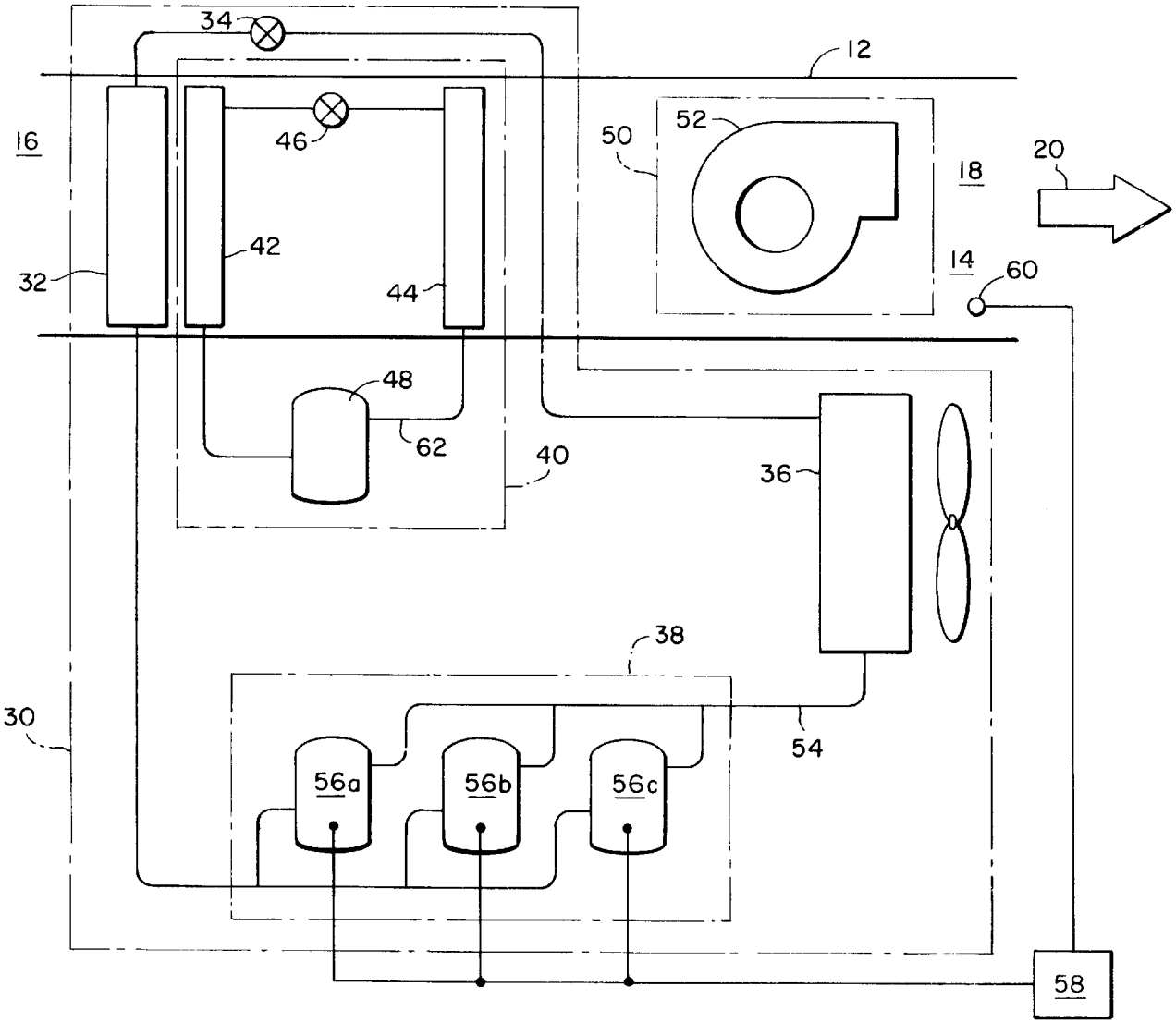
FIG. 1 is a diagram of a fresh air unit in accordance with the present invention.

FIG. 1 shows a fresh air unit 10 which is also referred to as a dedicated outdoor air unit or as an outdoor air conditioning unit throughout this application. The fresh air unit 10 can be implemented as a water source heat pump, a vertical or horizontal fan coil, a constant volume direct expansion rooftop unit, a constant volume direct expansion split system, a blower coil, a packaged terminal air conditioner, or the like. Suitable systems are sold by The Trane Company, a Division of American Standard Inc., under the trademarks Command Air™, UniTrane™, Voyager™, and Odyssey™. Additionally, various air handlers such as those sold by The Trane Company under the trademarks Modular Climate Changer™ and Climate Changer™ are suitable.

The fresh air unit 10 includes a housing 12 arranged about an air path 14. The air path 14 has an outdoor air inlet 16 connected to a source of outdoor air, and has a building outlet 18 connected to a space or spaces and providing supply air to the space or spaces requiring a fresh air supply. An airstream 20 flows through the housing 12 and along the airflow path 14 from the inlet 16 to the outlet 18.

In its preferred embodiment, the fresh air unit 10 includes a pre-cooling portion 30, a dehumidification portion 40 and an air moving portion 50.

The pre-cooling portion 30 includes an evaporator section 32 located in the airstream 20 of the housing 12. The pre-cooling portion 30 also includes an expansion section 34 such as an expansion valve or metering device, a condenser section 36 such as an air or liquid cooled condenser, and a compressor section 38. All but the evaporator section 32 are preferably located out of the airstream 20.

The dehumidification portion 40 includes an evaporator section 42 located in the airstream 20, a condenser section 44 also located in the airstream, an expansion section 46 such as an expansion valve or metering device, and a compressor section 48.

The air moving portion 50 includes a blower 52. The blower 52 can be located in the air path 14 at any convenient location to motivate the airflow 20 through the housing 12. In the preferred embodiment, the blower 52 is located proximal the outlet 18 but could just as well be located near the inlet 16 or between condenser and/or evaporator sections.

The evaporator section 32, the expansion section 34, the condenser section 36, and the compressor section 38 of the pre-cooling portion 30 are serially linked into an independent air conditioning circuit 54. The compressor section 38 is shown as a set of manifolded compressors 56 but could also be implemented as a variable capacity compressor such as those sold by The Trane Company under the trademark Series R™. The compressor section 38 is controlled by a controller 58 in response to the supply air temperature as measured by a sensor 60. A suitable controller 58 is sold by The Trane Company under the identifier PCM and suitable manifolded compressors 56 are sold by The Trane Company under the trademarks Climatuff™, Cornerstone™, and 3D™.

The evaporator section 42, the expansion section 46, the condenser section 44 and the compressor section 48 of the dehumidification portion 40 are serially linked into an independent air conditioning circuit 62. The condenser section 44 is located in the air path 14 downstream of the evaporator section 42, and the evaporator section 42 is located in the air path 14 downstream of the pre-cooling evaporator section 32 and upstream of the dehumidification condenser section 44. The evaporator section 32, the evaporator section 42, and the condenser section 44 are preferably conventional DX expansion coils such as those sold by The Trane Company but can be replaced by any air-to-liquid heat exchangers.

FIG. 2 is a psychrometric chart 70 showing the operation of the dehumidification portion 40 of the present invention. Although the temperatures shown in FIG. 2 are typical, they will vary dependent on specific outdoor conditions and airflow rates. As is conventional in such charts, the removal of moisture is indicated on the vertical axis 78 and the change in dry bulb temperature is indicated on the horizontal axis 80. The operation of the evaporator section 42 cools the outside air while removing the moisture as indicated by line 72 running from a point 74 to a point 76. In the present invention, the dehumidification portion 40 is sized to provide a desired amount of reheat as evidenced by the line 84 running from point 76 to point 82 of the chart 70. The horizontal flatness of line 84 indicates that the moisture content of the airstream 20 is unchanged but that the airstream 20 experiences sensible heat gain. Effectively, if operation of the dehumidification portion 40 commences at the point 74, the dehumidification portion 74 will provide a constant amount of moisture removal in the airstream and will reheat the airstream to the point 82.

The pre-cooling portion 30 is operated to reduce the outdoor air entering the inlet 16 from its ambient temperature to a desired dewpoint condition entering the dehumidification portion 40. That desired dewpoint condition is represented by the point 74 on the chart 70. Since the dehumidification portion 40 provides a constant amount of moisture removal and reheat, and if the pre-cooling portion 30 is operated to bring the condition of the outside air to the point 74, the building or space being controlled will always receive supply air having a temperature and humidity level in accordance with design conditions as indicated by point 82.

Since the heat gain from the dehumidification portion 40 is constant, the temperature of the airstream 20 can be measured anywhere in the air path 14 and the manifolding of the compressors 56 or the capacity of the variable capacity compressor controlled accordingly. Preferably, the sensor 60 is located downstream of the evaporator and condenser section 32, 42, 44 since the controller 58 can then modulate the capacity of the pre-cooling air conditioning circuit 54 to maintain the supply air temperature as measured by that sensor 60. If the sensor 60 were located upstream of the evaporator or condenser sections 42, 44, the controller 58 would have to compensate for the effects of those sections 42, 44. With the sensor 60 located downstream of those sections 32, 42, 44, the controller 58 need compensate only for variations in the entering air temperature through the inlet 16 and for variations in the speed of the airstream 20 as motivated by the blower 52.

FIG. 3 shows the dehumidification capabilities of the fresh air unit 10 at various airflow conditions. FIG. 3 is a graph 90 having a vertical axis 92 showing dewpoint and a horizontal axis 94 showing supply air dry bulb temperature. Line 96 indicates nominal airflow whereas line 98 equals a 20% increase in airflow over the nominal airflow and line 100 equals a 20% decrease in airflow from the nominal airflow. Line 102 indicates a 40% decrease in airflow from the nominal airflow 96. Given a desired airflow, such as the 20% decrease shown by the line 100, and given a desired dewpoint, such as represented by the point 95, a point 97 can be determined on the line 100 representing the intersection of the line 100 with a horizontal line 99 from the desired dewpoint 95. By dropping a vertical line 101 from the intersection point 97, a desired supply air temperature 103 is identified where the desired supply air temperature corresponds to the desired dewpoint temperature 95.

Figure 4:
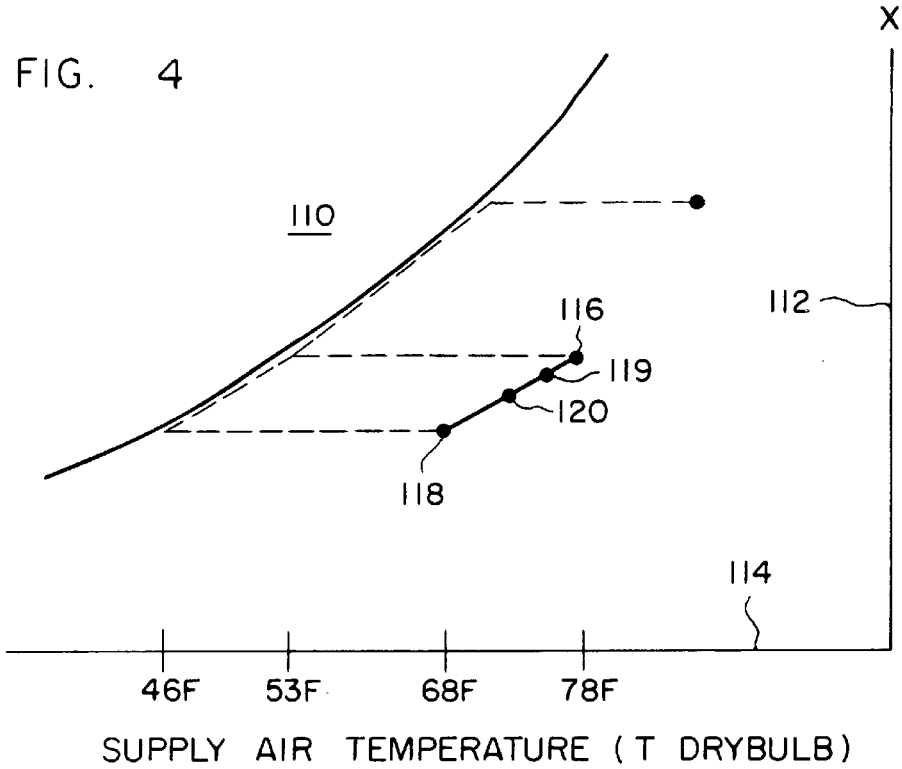
FIG. 4 is a psychrometric chart showing supply air temperature control with regard to FIG. 1.

FIG. 4 is a psychrometric chart 110 of the preferred embodiment illustrating how the unit is controlled based upon the desired supply air temperature 103 to thereby maintain the desired dewpoint temperature 95. In FIG. 4, humidity is measured on the vertical axis 112 and dry bulb temperature is measured on the horizontal axis 114. By controlling the amount of time that the compressor 56 operates at control point 116 and at control point 118, an average supply air temperature can be controlled to any point on the line 120 between the control points 116 and 118. By controlling to such an average supply air temperature, the dewpoint can be indirectly controlled at any point on line 120. Essentially, if the operation of a single compressor 56*a* results in operation at control point 116, and the operation of compressors 56*a* and 56*b* results in operation at control point 118, then one of these compressors 56*a*, 56*b* can be staged on and off by time in proportion to the location of the desired point on line 120. For example, a point half way between the points 116 and 118 could be reached by operating compressor 56*a* all the time and by operating compressor 56*b* half of the time. The actual result will be imprecise, but will provide acceptable operational conditions.

Figure 7:
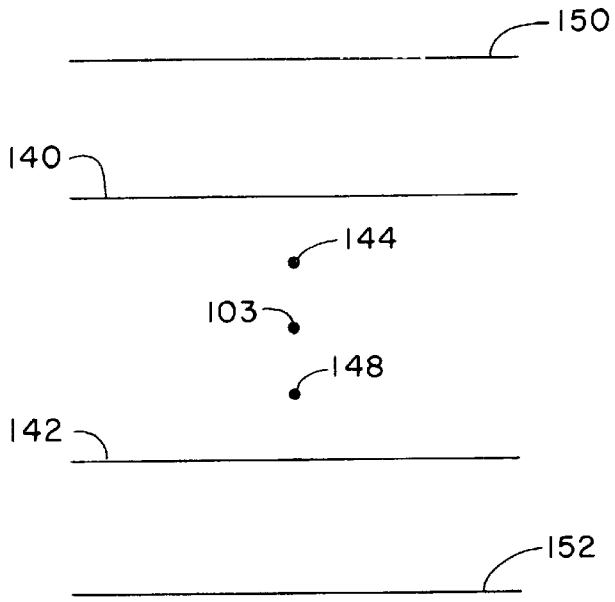
FIG. 7 is a control chart illustrating the operation of FIG. 4.

As shown in FIG. 7, the desired supply air temperature 103 (as determined in connection with FIGS. 3 and 4) is positioned by staging compressors 56 such that the desired supply air temperature 103 lies between an upper threshold 140 and lower threshold 142, and the system is operated at either control point 116 or at control point 118 to maintain that desired supply air temperature 103. System operation is preferably determined by a reading from the temperature sensor 60. The operation at the control point 116 tends to move system operation towards the threshold line 140 and away from the desired supply air temperature 103 as indicated by point 144. Operation at control point 118 tends to move system operation toward the threshold line 142 and away from the desired supply air temperature as indicated by point 148. As such, an error condition develops reflecting the difference between the operating point 144,148 at any given time and the desired supply air temperature 103. This error is integrated over time and is reflected by the following formula:

$$\text{ERRORdrybulb}=\Sigma(\text{Tsensor}(60)-\text{Tsetpoint, drybulb})$$

where Tsensor(60) is the temperature measure by the sensor 60 and Tsetpoint,drybulb is the drybulb setpoint temperature.

Whenever the accumulated ERRORdrybulb reaches a threshold 140, the control point is shifted, in this case from control point 116 to control point 118. This acts to reverse the error condition and move system operation towards the opposite threshold 142 as indicated, for example, by operation at control point 148. The error condition is continually integrated and the control points 116, 118 are switched whenever the accumulated errors measured by ERRORdrybulb meet or exceed a controlled threshold 140, 142. Additional threshold lines 150 and 152 can be provided to add or remove compressor stages so as to shift the operating envelope in response to an inability of the present compressor staging to meet a desired users setpoint. Threshold 150 indicates that a compressor 56 should be turned on, whereas threshold 152 indicates that a compressor 56 should be turned off. These additional thresholds 150,152 will usually only be reached when the present operating envelope is incapable of maintaining the desired conditions.

Statepoints 116 and 118 are utilized as detailed above and in connection with FIG. 4. The number of base cooling stages are adjusted by turning on enough of compressors 56*a*, 56*b* and/or 56*c* such that the desired average operating temperature 103 is between states 116 and 118 and as determined by ERRORdrybulb reaching thresholds 150,152. The unit is then cycled by staging a compressor to achieve an average operating condition in a fashion similar to that described above.

| Condition | Calculation | Response |
|---|---|---|
| Average discharge air temperature too cold | ERRORdrybulb < Threshold 142 | Go to Statepoint 116 (maximum temperature for given control envelope) |
| Average Discharge air temperature too warm | ERRORdrybulb > Threshold 140 | Go to Statepoint 118 (Minimum temperature for given control envelope) |

Generally speaking, the building operator will want to operate the unit at an average discharge dewpoint condition such as represented by the point 95 in FIG. 3. As described above, FIG. 3 is used to determine the appropriate discharge dry bulb temperature setpoint 103 at a given set of dewpoint and airflow conditions. With a given airflow, the proper operating curve is chosen on FIG. 3. The desired dewpoint temperature is then used to determine the position on operating curve. The appropriate discharge dry bulb setpoint can then be determined from the horizontal axis.

Figure 5:
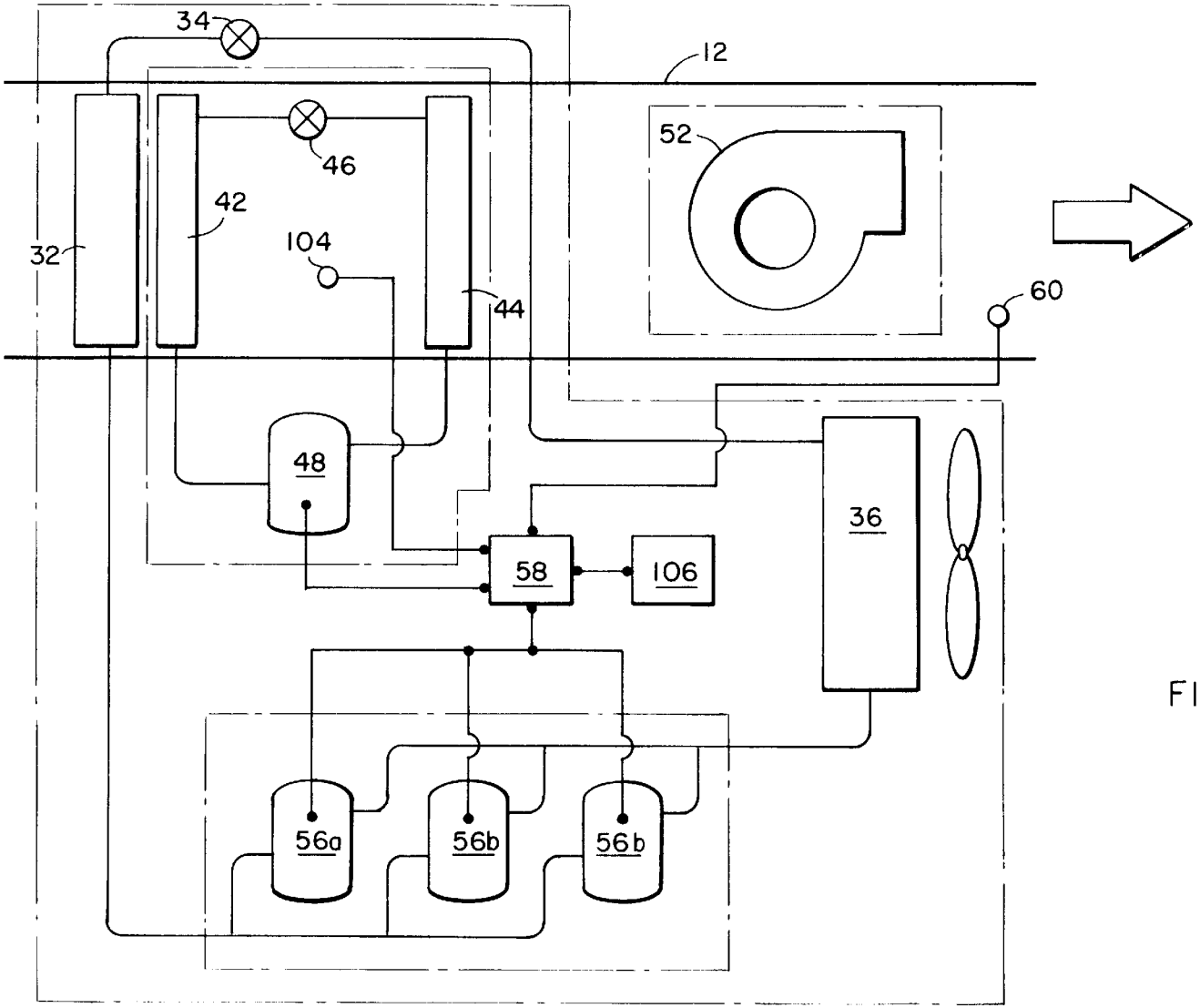
FIG. 5 is a diagram of an alternative embodiment of the present invention.

FIG. 5 illustrates an alternative embodiment essentially similar to the embodiment shown in FIG. 1 but wherein the controller 58, either as a common controller or as a separate controller, is capable of varying independently the amount of latent and sensible cooling produced by the unit. Reference numbers are commonly used in FIGS. 1 and 4 where they describe a common element. One of the advantages of the alternative embodiment is that it is more responsive to varying airflow and outdoor conditions.

Figure 6:
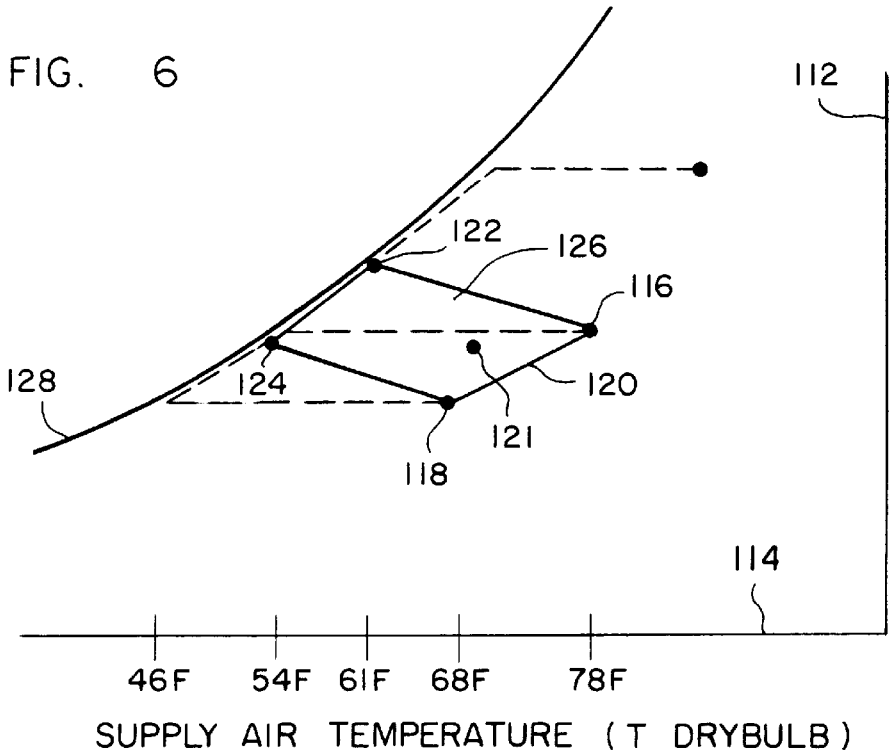
FIG. 6 is a psychrometric chart showing supply air temperature control and dewpoint temperature control with regard to FIG. 5.

This process is illustrated in FIG. 6 as shown by statepoints 116, 118, 122, 124. These operational statepoints 116, 118, 122, 124 are chosen based on the required latent and sensible changes required to meet the desired dry bulb and dewpoint control points. Typically the control method will use temperature as measured by a dewpoint temperature sensor 104 and the dry bulb temperature sensor 60.

The control envelope 126 defined by FIG. 6 is defined by the statepoints 116, 118, 122, 124 as follows:

Statepoint 122—the dehumidifier portion is OFF, and the pre-cooling portion 30 has "i" stages of cooling ON (in a 3 stage pre-cooling system as shown in FIG. 5, "i" may be equal to 0, 1 or 2 stages of cooling).

Statepoint 116—the dehumidifier portion 40 is ON, and the pre-cooling portion 30 has "i" stages of cooling ON.

Statepoint 124—the dehumidifier portion 40 OFF, and the pre-cooling portion 30 has "i+1" stages of cooling ON (in this case, "i" may still be equal to 0, 1 or 2 and respective 1, 2 or 3 stages of cooling may result).

Statepoint 118—the dehumidifier portion 40 is ON, and the pre-cooling portion 30 has "i+1" stages of cooling ON.

By utilizing the preceding statepoints 116, 118, 122, 124, an operation/control envelope 126 can be established using the controller 58 to achieve an average sensible and latent condition within the control envelope 126 as determined by control setpoints for dry bulb temperature and dewpoint temperature.

Typical control operation determine control bands about the dewpoint setpoint for latent capacity and about the dry bulb setpoint for sensible capacity. As more latent capacity is required, the unit 10 is set to operate at statepoint 118. As less latent capacity is required, the unit 10 is set to operate at statepoint 122. Sensible capacity is operated in a similar fashion between the statepoint 116 and the statepoint 124. The overall control envelope 126 is moved along the 100% RH line on the psychrometric chart 110 by choosing the appropriate number of base cooling stages (statepoint 122) to either 0, 1 or 2 compressor operation in the pre-cooling portion 30. Other control algorithms can be used in order to optimally choose the best state to operate depending on a combination of the required latent and sensible capacity changes required in response to the measured deviations from the desired dewpoint and dry bulb temperatures. Other sensor combinations may be used to determine moisture levels in the discharge airstream (e.g. dry bulb temperature and % RH can be used to calculate dewpoint temperature).

Although both the average dry bulb and dewpoint temperatures can be controlled simultaneously, statepoints 116, 118, 122, 124 do not represent control points that allow control response to temperature or humidity independent of the other. As such, the operating state is chosen dependent on which of the parameters deviates most from an "in-control" status. The statepoints 116,118,122,124 in FIG. 6 detail the corners of a control envelope 126 (i.e. maximum and minimum dry bulb temperature and maximum and minimum humidity levels) and are chosen to bring the parameter (humidity or temperature) that is most out of control, back to an "in-control" status.

The "in-control" status is monitored by an integrated error function for both dry bulb (ERRORdrybulb) and dewpoint (ERRORdewpoint) temperatures. In general, the integrated error function keeps a running total of how the temperature deviates from the desired setpoint. By integrating the temperature error as referenced to the setpoint and forcing the integrated error to zero, an average dry bulb and dewpoint temperature can be maintained at setpoint. An integrated error function can be approximated by a summation of the measured error as follows:

$$\text{ERRORdrybulb}=\Sigma(\text{Tsensor}(60)-\text{Tsetpoint,drybulb})$$

$$\text{ERRORdewpoint}=\Sigma(\text{Tsensor}(104)-\text{Tsetpoint,dewpoint})$$

where Tsensor(60) is the temperature measured by the sensor 60, Tsetpoint,drybulb is the drybulb temperature setpoint, Tsensor(104) is the temperature measured by the sensor 104 and Tsetpoint,dewpoint is the dewpoint temperature setpoint. The dewpoint and temperature control setpoints 106 are conventionally entered by a user from a terminal or a building automation system, can be preprogrammed in the controller's memory, or may be periodically adjusted from the building automation system or from building feedback sensors in response to building requirements. A suitable building automation system is sold by The Trane Company under the trademark Tracer.

The summation described above is updated at regular intervals.

Figure 8:
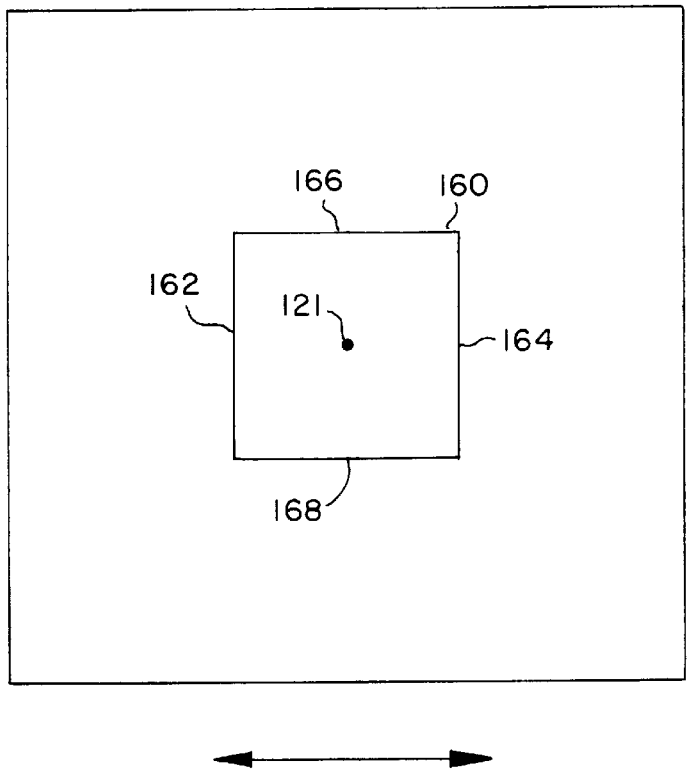
FIG. 8 is a control chart illustrating the operation of FIG. 6.

In FIG. 8 a desired operating point 121 is selected and the system operated at one of the control points 116, 118, 122 or 124. The operation at that particular control point tends to move the operating condition towards that control point and to change the accumulated humidity and temperature error conditions: ERRORdrybulb, ERRORdewpoint. Eventually either the accumulated temperature or the accumulated humidity error condition will cross the control threshold 160 illustrated in FIG. 8 and cause a transition to the control point most suitable for controlling whichever error and whichever threshold was crossed. For example, if the temperature becomes too cold then the control point is shifted to 116, that being the warmest control point. On the hand, if the temperature becomes too warm due to prolonged operation at point 116, the temperature would be shifted to the coldest control point 124. If the humidity becomes too great then operation is shifted to control point 118 since that control point is the driest. Should conditions become too wet, then operation is shifted to control point 122 since that control point is the wettest control point. By constantly shifting in response to actual conditions, the desired conditions 121 can be maintained. Thresholds 162,164,168 and 166 are respectively associated with control points 116,124,122 and 118.

A typical control response might be as follows:

| Condition | Calculation | Response |
|---|---|---|
| Average discharge air temperature too cold | ERRORdrybulb > Threshold 162 | Go to Statepoint 116 (maximum temperature for given control envelope) |
| Average Discharge air temperature too warm | ERRORdrybulb > Threshold 164 | Go to Statepoint 124 (Minimum temperature for given control envelope) |
| Average Discharge air humidity to dry | ERRORdewpoint < Threshold 168 | Go to Statepoint 122 (maximum humidity condition for given control envelope) |
| Average Discharge air humidity too humid | ERRORdewpoint > Threshold 166 | Go to Statepoint 118 (minimum humidity condition for given control envelope) |

Compressor staging can be accomplished using an additional threshold 170 similar to thresholds 150,152 described above.

By using at least three, or optionally all four, control points 116, 118, 122, 124, the control envelope 126 can be established within these boundary points 116, 118, 122, 124.

Basically, independent control of the average dry bulb temperature and independent control of the average dewpoint temperature both occur within the control envelope 126. In order to achieve these independent controls, sensors 60, 104 are required to measure each criteria. The supply air temperature is sensed by the dry bulb sensor 60 and the humidity level is sensed by placing the dry bulb sensor 104 between the evaporator section 42 and the condenser section 44. A dry bulb sensor 104 so located will provide a temperature measurement as a function of dewpoint. Since the temperature measured by the sensor 104 can be assumed to be close to the 100% relative humidity curve 128, the temperature sensor 104 can be assumed to be sensing and measuring the dewpoint temperature.

For example with reference to FIG. 4, if it is desirable to maintain the system operation at a control point 119 approximately 80% of the spacing between the control points 116 and 118, an incremental compressor stage is duty cycled on 20% of the time. Although not perfectly accurate, the degree of control so provided is acceptable. Basically, the dehumidification portion 40 is duty cycled to control humidity by cycling vertically parallel to ordinate 112, and the precooling portion 30 is duty cycled to control temperature by cycling horizontally parallel to abscissa 114. Of course each system may be duty cycled individually to provide either temperature or humidity control.

The foregoing invention has been described in terms of a fresh air unit which alleviates various indoor air quality problems by introducing dry air into the controlled space at temperature neutral conditions. Although the humidity removal is preferred to be a constant so as to allow temperature control by modulation of the sensible cooling system, the system can also be modified to modulate the temperature independent of humidity. It will be apparent to a person of ordinary skill in the art that many alterations and modifications of this system are apparent. Such modifications and alterations include the substitution of various conventional compressor equipment, heat exchange equipment, and expansion valve equipment in place of those described in this application. Additionally, the application of the equipment will vary to include air handling in a commercial sense through the gamut to air handling in a residential sense. The control envelope 126 could be controlled using three statepoints (or five or more statepoints) rather than the four state points discussed above. More importantly, the number of pre-cooling stages may be varied, and one or more dehumidification stages may be included. This would allow additional control points within the envelope and would allow the size and shape of the control envelope to be modified as desired. Additionally, the addition of a dewpoint sensor in the airflow stream allows direct control of dewpoint temperature. This sensor would preferably be located with the drybulb temperature sensor. All such modifications and alterations are intended to be encompassed by the claimed invention.

What is desired to secured for Letters Patent of the United States is set forth in the following claims:

1. A fresh air unit comprising:

a housing having an airstream flowing therethrough;

a pre-cooling portion, located within the housing, for reducing the temperature and moisture level of a gas in the airstream to a predetermined target zone on a psychrometric chart; and a dehumidification portion, located in the housing downstream of the pre-cooling portion, for removing a selected amount of moisture from the gas and for reheating the gas a selected amount of sensible heat gain.

2. The fresh air conditioning unit of claim 1 wherein the dehumidification portion includes a compressor section, a condenser section, an expansion section, and an evaporator section, all serially linked in a latent air conditioning circuit and wherein the evaporator section and the condenser section of the dehumidification portion are located in the airstream.

3. The fresh air conditioning unit of claim 2 wherein the evaporator section is upstream of the condensing section and wherein the condensing section is sized to provide a predetermined sensible heat gain from the condensing section.

4. The fresh air conditioning unit of claim 3 wherein the dehumidification evaporator section is sized to provide a desired amount of moisture removal.

5. The fresh air conditioning unit of claim 4 further including a controller for the pre-cooling portion operably connected to the pre-cooling portion and controlling its operation to a control point.

6. A fresh air unit comprising:

a housing having an airstream flowing therethrough;

a pre-cooling portion, located within the housing, for reducing the temperature and moisture level of a gas in the airstream to a predetermined target zone on a psychrometric chart; and a dehumidification portion, located in the housing downstream of the pre-cooling portion, for removing a selected amount of moisture from the gas and for reheating the gas a selected amount of sensible heat gain; and a controller for the pre-cooling portion operably connected to the pre-cooling portion and controlling its operation to a control point;

wherein the dehumidification portion includes a compressor section, a condenser section, an expansion section, and an evaporator section, all serially linked in a latent air conditioning circuit;

wherein the evaporator section and the condenser section of the dehumidification portion are located in the airstream;

wherein the evaporator section is upstream of the condensing section;

wherein the condensing section is sized to provide a predetermined sensible heat gain from the condensing section;

wherein the dehumidification evaporator section is sized to provide a desired amount of moisture removal; and wherein the control point of the controller is user selectable.

7. A fresh air unit comprising:

a housing having an airstream flowing therethrough;

a pre-cooling portion, located within the housing, for reducing the temperature and moisture level of a gas in the airstream to a predetermined target zone on a psychrometric chart;

a dehumidification portion, located in the housing downstream of the pre-cooling portion, for removing a selected amount of moisture from the gas and for reheating the gas a selected amount of sensible heat gain; and a controller for the pre-cooling portion operably connected to the pre-cooling portion and controlling its operation to a control point;

wherein the dehumidification portion includes a compressor section, a condenser section, an expansion section, and an evaporator section, all serially linked in a latent air conditioning circuit;

wherein the evaporator section and the condenser section of the dehumidification portion are located in the airstream;

wherein the evaporator section is upstream of the condensing section;

wherein the condensing section is sized to provide a predetermined sensible heat gain from the condensing section;

wherein the dehumidification evaporator section is sized to provide a desired amount of moisture removal; and wherein the control point is a preselected point on a psychrometric chart.

8. The fresh air conditioning unit of claim 7 further including a controller for the dehumidification portion.

9. The fresh air conditioning unit of claim 8 wherein the controllers modulate the operation of the pre-cooling and dehumidification portions to user selectable setpoints.

10. A fresh air unit comprising:

a housing having an airstream flowing therethrough;

a pre-cooling portion, located within the housing, for reducing the temperature and moisture level of a gas in the airstream to a predetermined target zone on a psychrometric chart; and a dehumidification portion, located in the housing downstream of the pre-cooling portion, for removing a selected amount of moisture from the gas and for reheating the gas a selected amount of sensible heat gain; and a controller for the pre-cooling portion operably connected to the pre-cooling portion and controlling its operation to a control point;

wherein the dehumidification portion includes a compressor section, a condenser section, an expansion section, and an evaporator section, all serially linked in a latent air conditioning circuit;

wherein the evaporator section and the condenser section of the dehumidification portion are located in the airstream;

wherein the evaporator section is upstream of the condensing section;

wherein the condensing section is sized to provide a predetermined sensible heat gain from the condensing section;

wherein the dehumidification evaporator section is sized to provide a desired amount of moisture removal; and wherein the pre-cooling portion is an air conditioning system comprising a compressor section, a condenser section, an expansion section and an evaporator section, all serially linked to form an air conditioning circuit and wherein the evaporator section of the precooling portion is located in the airstream.

11. The fresh air conditioning unit of claim 10 wherein the condenser section and the compressor section are not located in the airstream.

12. The fresh air conditioning unit of claim 10 wherein the compressor section includes a variable speed compressor.

13. The fresh air conditioning unit of claim 10 wherein the compressor section comprises a set of manifolded compressors and the compressors are staged.

14. The fresh air conditioning unit of claim 10 further including a blower in the housing providing a motive force to the airstream.

15. The fresh air conditioning unit of claim 2 wherein the evaporator section is upstream of the condensing section and wherein the evaporator section is sized to remove a predetermined amount of moisture.

16. The fresh air conditioning unit of claim 15 wherein the condensing section is sized to provide a desired sensible heat gain.

17. A method of operating a fresh air unit having a precooling portion and a dehumidification portion, the method comprising the steps of:

adjusting the capacity of the precooling portion;

operating the precooling portion to control sensible and latent temperatures to a predetermined area of a psychrometric chart; and operating the dehumidification section to provide a constant amount of dehumidification and a constant amount of reheat.

18. The method of claim 17 wherein operating the precooling portion step includes the further steps of establishing two or more adjacent cooling stages, cycling between these stages and controlling a discharge air temperature to a setpoint.

19. The method of claim 18 wherein average supply air dewpoint is controlled by establishing an average supply air drybulb temperature.

20. A method of operating a fresh air unit having a precooling portion and a dehumidification portion, the method comprising the steps of:

adjusting the capacity of the precooling portion;

operating the precooling portion to control sensible and latent temperatures to a predetermined area of a psychrometric chart; and operating the dehumidification section to provide a constant amount of dehumidification and a constant amount of reheat;

wherein the operating the precooling portion step includes the further steps of establishing two or more adjacent cooling stages, cycling between these stages and controlling a discharge air temperature to a setpoint;

wherein the average supply air dewpoint is controlled by establishing an average supply air drybulb temperature; and including the further steps of cycling at least a portion of the dehumidification section on and off to establish additional control points.

21. The method of claim 20 including the further steps of cycling the unit at the control points and thereby independently controlling average drybulb temperature and average dewpoint temperature.

22. A method of operating a fresh air unit having a precooling portion and a dehumidification portion, the method comprising the steps of:

adjusting the capacity of the precooling portion;

operating the precooling portion to control sensible and latent temperatures to a predetermined area of a psychrometric chart;

operating the dehumidification section to provide a constant amount of dehumidification and a constant amount of reheat;

wherein the operating the precooling portion step includes the further steps of establishing two or more adjacent cooling stages, cycling between these stages and controlling a discharge air temperature to a setpoint;

wherein the average supply air dewpoint is controlled by establishing an average supply air drybulb temperature; and wherein the precooling portion includes at least one compressor and wherein the operating the precooling portion step includes the further step of cycling the precooling compressor on and off to maintain an average supply air temperature and thereby indirectly controlling dewpoint.

23. The method of claim 22 including the further step of providing a constant airflow sequentially through the precooling portion and the dehumidification portion.

24. The method of claim 22 including the further steps of independently cycling the precooling portion to maintain an average dry bulb temperature and independently cycling the dehumidifier portion to maintain an average dewpoint temperature within the control envelope.

25. The method of claim 24 including the further step of placing a dry bulb sensor between an evaporator and a condenser of the dehumidifier portion.

26. The method of claim 24 wherein the precooling portion includes at least two compressors and wherein operating the precooling portion step includes the further step of staging the at least two compressors.

* * * * *

UNITED STATES PATENT AND TRADEMARK OFFICE

CERTIFICATE OF CORRECTION

PATENT NO : 6,170,271

DATED : January 9, 2001

INVENTOR(S) : Brian T. Sullivan

It is certified that error appears in the above-identified patent and that said Letters Patent are hereby corrected as shown below:

Column 10, Line 20, ">" should read -- < --.

Signed and Sealed this

Eighth Day of May, 2001

*Attest:*

Nicholas P. Godici

NICHOLAS P. GODICI

*Attesting Officer*

*Acting Director of the United States Patent and Trademark Office*